United States Patent [19]

Onoda

[11] Patent Number: 4,932,918

[45] Date of Patent: Jun. 12, 1990

[54] TOP SPINNING TOY

[75] Inventor: Takayuki Onoda, Tateishi, Japan

[73] Assignee: Tomy Kogyo Co., Inc., Tokyo, Japan

[21] Appl. No.: 232,009

[22] Filed: Aug. 15, 1988

[30] Foreign Application Priority Data

Sep. 3, 1987 [JP] Japan ..... 62-134756[U]

[51] Int. Cl.[5] ..... F63H 1/02

[52] U.S. Cl. ..... 446/260; 446/256

[58] Field of Search ..... 496/38, 39, 40, 43, 496/256, 257, 258, 259, 260, 266

[56] References Cited

U.S. PATENT DOCUMENTS

| | | | |
|---|---|---|---|
| 202,118 | 4/1878 | Raetz | 446/260 |
| 1,368,039 | 2/1921 | Lindstrom | 446/260 |
| 2,245,936 | 6/1941 | Nicholas | 446/260 |
| 2,657,498 | 11/1953 | Gustine | 446/260 |
| 2,818,675 | 1/1958 | Glass et al. | 446/260 |
| 2,966,004 | 12/1960 | Schustrin | 446/260 X |
| 3,224,142 | 12/1965 | Pawelka et al. | 446/259 X |

FOREIGN PATENT DOCUMENTS

| | | | |
|---|---|---|---|
| 913276 | 6/1953 | Fed. Rep. of Germany | 446/260 |
| 951627 | 10/1949 | France | 446/260 |
| 47-25679 | 8/1972 | Japan . | |
| 2035107A | 6/1980 | United Kingdom | 446/260 |

*Primary Examiner*—Robert A. Hafer
*Assistant Examiner*—Sam Rimell
*Attorney, Agent, or Firm*—Staas & Halsey

[57] ABSTRACT

A top spinning toy has a spring wound mechanical motor which rotates a socket having a spiral groove formed therein. A top has a spiral projection formed on an outer surface thereof and is screwed into the socket. The socket is rotated in the same direction as the top-inserting direction until a coil spring within the spring wound mechanical motor is wound tight. A release mechanism causes the spring tension to release and rotate the socket in a direction opposite the winding direction. The top leaves the socket automatically at a high speed and is capable of spinning for a long time.

17 Claims, 3 Drawing Sheets

TOP SPINNING TOY

BACKGROUND OF THE INVENTION

1. Field of the Invention

The present invention relates generally to a top spinning toy, and more specifically, to a top spinning toy which has an increased force of rotation, and which allows a top to be spun by a one-touch operation.

2. Description of the Related Art

A device for spinning a top without using a string is described in Japanese Utility Model Publication No. 47-25679. The device disclosed therein includes a drive shaft supported in a cylindrical body and having a spring disposed thereon. A top is twisted or rotated by a spiral engaging pawl provided on a lower end of the drive shaft which engages a spiral pawl provided on the center of an upper surface of the top. The top is fitted into the cylindrical body by virtue of an elastic repulsion of the spring so that it may store more driving force. By pushing a push button projecting from an upper portion of the cylindrical body, the drive shaft moves downwardly thus releasing the top from the cylindrical body. As a result, the top drops from the drive shaft to the ground and rotates thereon.

In the aforementioned device, the time for transmitting rotation of the drive shaft to the top is as short as the time from when pushing the push button causes a ratchet pawl to be detached from ratchet teeth of the top to when the spiral engaging pawl provided on the drive shaft is detached from the spiral pawl of the top. Thus, this short period of time does not contribute sufficiently to the transmission of the rotation of the drive shaft to the top.

SUMMARY OF THE INVENTION

An object of the present invention is to provide a top spinning toy which is simple to operate and provides increased force of rotation.

Another object of the invention is to provide a top spinning toy which allows a top to be spun by a one-touch operation.

In a preferred embodiment, a top spinning toy includes a spring wound mechanical motor having a rotatable shaft, a socket connected to the shaft and having an inner surface and a spiral groove formed in the inner surface, and a top having an outer surface and a spiral projection formed on the outer surface, the spiral projection of the top being receivable in the spiral groove of the socket, the spiral groove and projection providing means for transmitting rotational force of the socket to the top.

These objects, together with other objects and advantages which will be subsequently apparent reside in the details of construction and operation of the apparatus as more fully hereinafter described and claimed, reference being had to the accompanying drawings forming a part hereof, wherein like reference numerals refer to like parts throughout.

DETAILED DESCRIPTION OF THE PREFERRED EMBODIMENTS

Figure 1:
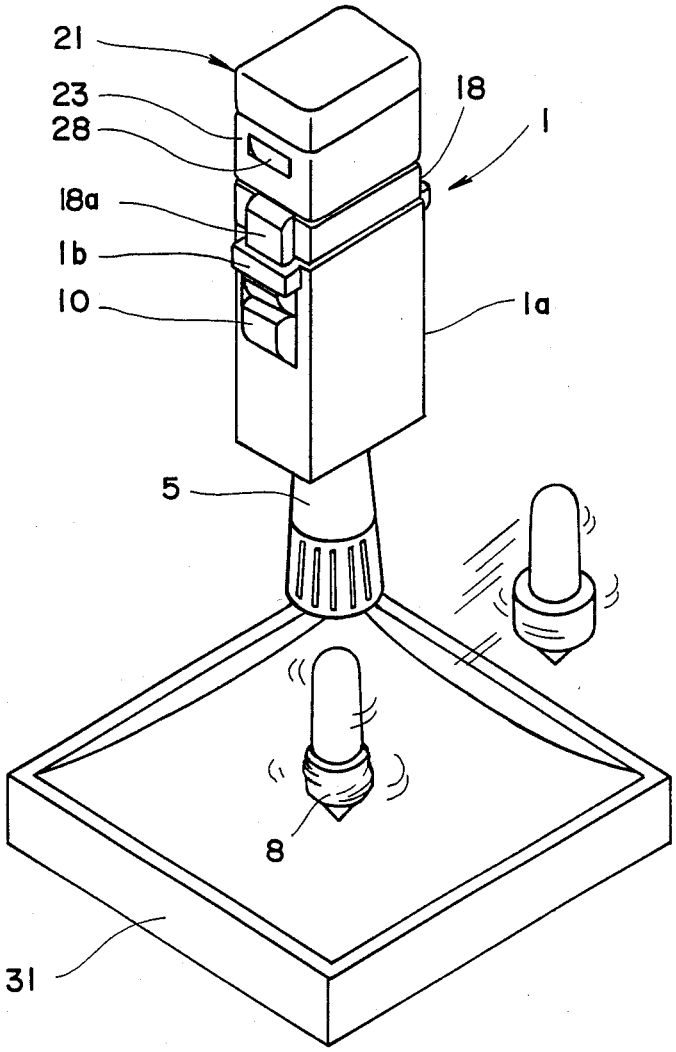
FIG. 1 is a perspective view of a first, preferred embodiment of the top spinning toy of the present invention.
Figure 2:
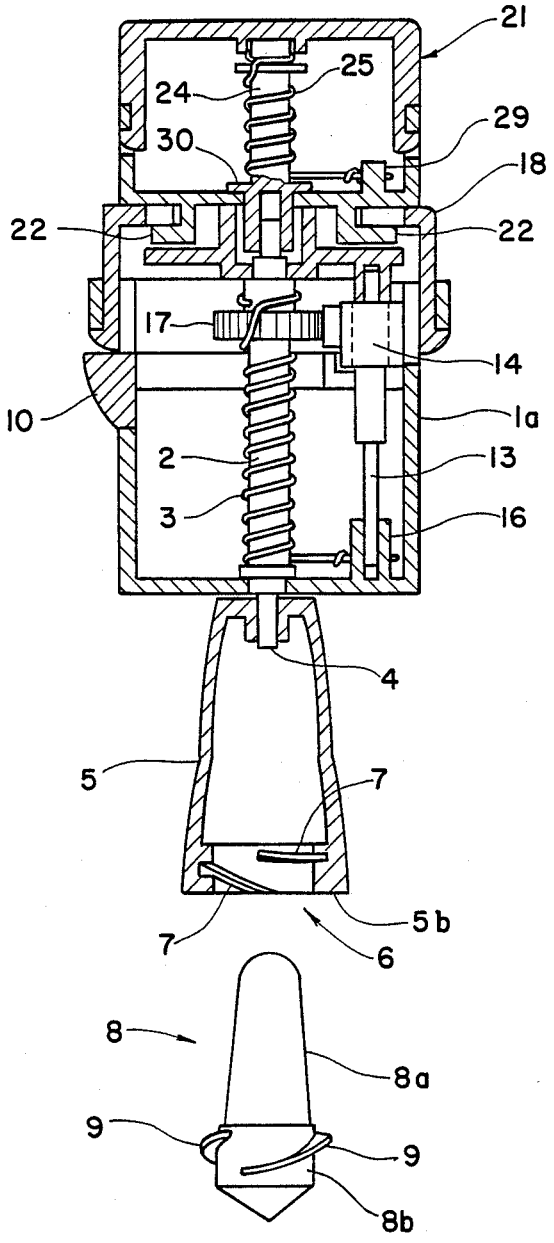
FIG. 2 is a vertical cross-sectional view taken through a top spinner shown in FIG. 1, and a side elevational view of a top shown in FIG. 1.
Figure 3:
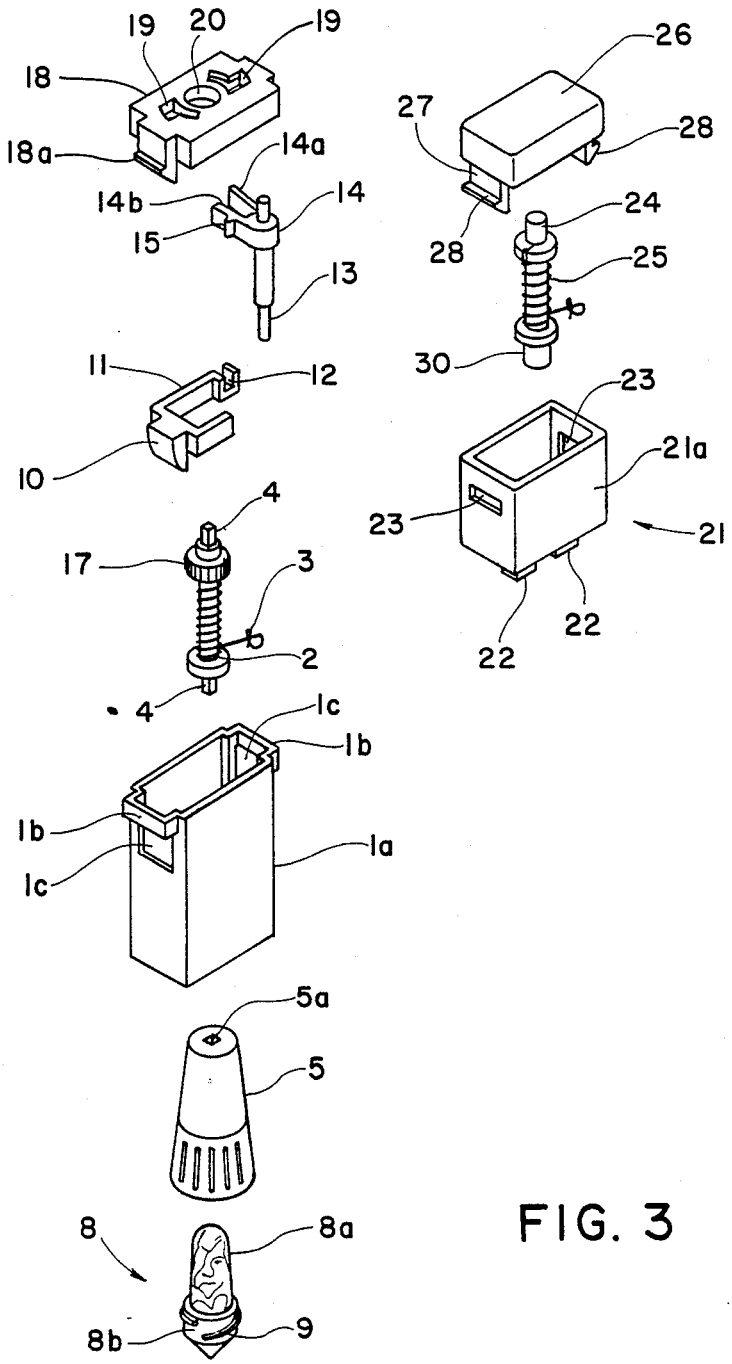
FIG. 3 is an exploded view of the top spinning toy shown in FIG. 1.

Referring to FIGS. 1–3, a top spinning toy includes a top spinner 1 having a main body 1*a* which is made of a synthetic resin and has a hollow interior. The main body 1*a* includes an upper shell 18 having snap-fitting arms 18*a* on opposite sides thereof for snap-fitting into receptacles 1*b* provided on opposite sides of the main body 1*a*.

As shown in FIGS. 2 and 3, an opening 1*c* is provided in the main body 1*a* just below one of the receptacles 1*b*. A push button 10 projects outwardly through opening 1*c*. The main body 1*a* houses a spring wound mechanical motor which includes a rotatable shaft 2 which has square end portions 4 protruding from opposite ends of the main body 1*a*. A socket 5 is attached to the lower end portion 4, and thus extends downwardly from the bottom of the main body 1*a*.

The upper shell 18 has a central bore 20 in which the rotatable shaft 2 is journaled. A top surface of the upper shell 18 is capable of receiving a supplemental power source 21 which is connectable to the upper end portion 4 of the rotatable shaft 2. The supplemental power source 21 increases the torque generated by the rotatable shaft 2, and thus rotates the socket 5 at an even higher speed. A top 8 placed inside the socket 5 is spun on a platform 31 having a concave surface. The platform 31 is provided as accessory to the top spinning toy.

The lower end portion 4 of rotatable shaft 2 provides power output for rotating the socket 5, which in turn spins the top 8 placed therein. The rotatable shaft 2 has a coil spring 3 wound thereon. One end of the coil spring 3 is connected to the rotatable shaft 2 and the opposite end is connected to a boss 16 integrally formed with the main body 1*a* in the interior thereof. The spring force generated by winding the coil spring 3 is applied as torque to the rotatable shaft 2.

Referring to FIGS. 2 and 3, the boss 16 in the interior of the main body 1*a* journals a lower end of a support shaft 13. The upper end of the support shaft 13 is journaled in a lower, outer portion of the upper shell 18. A forked elastic member 14 has a base portion which is connected to the support shaft 13. One branch 14*a* of the forked elastic member 14 is receivable in a groove 12 formed on a distal end of an arm 11 integrally formed with the push button 10. A second branch 14*b* is provided with a pawl 15 which, in the normal state, engages a ratchet wheel or gear 17 connected to the rotatable shaft 2. Due to the elasticity of the elastic member 14, the pawl 15 is normally biased into engagement with the gear 17. Thus, when the rotatable shaft 2 is rotated in a winding direction, thus winding the spring 3, the gear rotates under the pawl 15 and makes a sound similar to a ratchet. After winding, inward movement of the push button 10 causes the pawl 15 to disengage from the gear 17, thus allowing the rotatable shaft 2 to rotate rapidly in an unwinding direction with all of the force stored by virtue of winding the spring 3.

The lower square end portion 4 of the rotatable shaft 2 is fitted into a square hole 5*a* formed in the top surface of the socket 5. The socket 5 contains a hollow interior and an open lower end 6 from which the top 8 is released. An inner surface of the socket 5 has a spiral groove 7 formed therein.

The top 8 has an upper body portion 8*a* and a lower portion 8*b* having a cylindrical portion and a conically shaped tip portion on which the top spins. The cylindrical portion of the lower portion 8*b* is provided with a spiral projection 9 which is shaped to fit into the spiral groove 7 of the socket 5. The upper body portion 8*a* of the top may have a character (doll, face, etc.) painted thereon.

The top 8 is placed in the socket 5 by placing the body portion 8*a* in first until the spiral projection 9 abuts an end face 5*b* of the socket 5. Then, the top 8 is screwed into the socket by turning the top 8 in a clockwise direction, viewed from the bottom. The spiral groove has a length sufficient to allow one turn of the top 8. The socket 5 with the top screwed therein is then rotated clockwise (when viewed from the bottom) so that the coil spring 3 is wound on the rotatable shaft 2 and is placed under tension so as to store torque for rotation in an opposite, counter-clockwise direction. In this wound state, the detent 15 of the forked elastic piece 14 is in engagement with the gear 17 mounted on the rotatable shaft 2, thus locking the shaft and stopping rotation thereof until the push button 10 is pushed inwardly to release the lock. When released, the rotatable shaft 2 rotates in the counter-clockwise direction (as seen from the bottom); the release of the rotatable shaft 2 causes the socket 5 to rotate at a high speed. This rotation is transmitted to the top 8 through the interconnection of the spiral groove 7 and projection 9. The top 8, while being rotated at a high speed, drops from the lower end of the socket 5 by un-screwing itself from the spiral groove. Thus, when the push button 10 is depressed, thereby releasing the force stored in the coil spring, the top 8 receiving the torque automatically releases from the socket 5 by inertia forces. As a result, torque applied to the top is not diminished by the release of the top from the top spinner.

The supplemental power source 21, briefly described above, provides means for enhancing the torque exerted on the top 8, and contains openings 23 formed on opposite sides thereof which receive the headed ends 28 of snap fitting arms 27 which extend downwardly from a lid 26. The lid 26 and body portion 21*a* constitute a hollow casing in which a vertical, rotatable shaft 24 is supported. The rotatable shaft 24 has an auxiliary coil spring 25 wound thereon, one end of which is connected to the rotatable shaft 24 and the other end of which is connected to a projection 29 integrally formed within the hollow casing. A coupling 30 of the rotatable shaft 24 is fitted over the upper square end portion 4 of the rotatable shaft 2 in order to couple the two shafts. Protrusions 22 are provided on the lower surface of the supplemental power source 21 so as to be received in locking grooves 19 provided on an upper surface of the upper shell 18. The protrusions 22 and grooves 19 provide a twistlock complementary connection between the top spinner, which acts as a primary power source, and the supplemental power source 21. Thus, torque is applied to the rotatable shaft 2 by elastic repulsion of the coil spring 3 and the auxiliary coil spring 25. Thus, torque applied to the top 8 is enhanced.

In FIG. 1, two tops 8 are shown, with one top leaving the concave surface of the platform 31. In one embodiment of the present invention, at least two top spinners 1 are provided with a plurality of tops 8 so that two tops can be placed spinning on the concave surface at the same time. Since spinning tops tend to move on the concave surface, two tops will eventually collide and cause one to be repelled, as illustrated. The lower portions of the tops 8 may be made of a metal so that inertial forces keep the tops spinning longer.

The many features and advantages of the present invention are apparent from the detailed specification, and thus, it is intended by the appended claims to cover all such features and advantages of the top spinning toy which fall within the true spirit and scope of the invention. Further, since numerous modifications and changes will readily occur to those skilled in the art based upon the disclosure herein, it is not desired to limit the invention to the exact construction and operation illustrated and described.

Accordingly, all suitable modifications and equivalents may be resorted to falling within the scope and the spirit of the invention.

What is claimed is:

1. A top spinning toy comprising:

a spring wound mechanical motor having a body, a first rotatable shaft mounted in the body and having one end projecting outwardly from the body, and a spring encircling the shaft, said spring being wound by rotating of the shaft in a winding directory;

a ratchet mechanism including a ratchet wheel connected to the shaft inside the body, a pawl for preventing rotation in an unwinding direction, and a release button mounted on the body and being coupled to the pawl for releasing the pawl and causing rotation of the shaft in the unwinding direction;

a socket connected to the outwardly projecting end of the rotatable shaft and having an inner surface and a spiral groove formed in the inner surface; and a top having an outer surface and a spiral projection formed on the outer surface, the spiral projection of the top being receivable in the spiral groove of the socket, the spiral groove and projection providing means for transmitting rotational force of the socket to the top.

2. A top spinning toy according to claim 1, wherein the top has a conically shaped lower end, an elongated upper body, and a cylindrical portion between the upper body and the conically shaped lower end.

3. A top spinning toy according to claim 2, wherein the spiral projection is formed on the cylindrical portion of the top, the cylindrical portion having an outer diameter which is slightly smaller than an inner diameter of the socket.

4. A top spinning toy according to claim 1, further comprising a supplemental power source connectable to the first rotatable shaft for enhancing a power output of the first rotatable shaft.

5. A top spinning toy according to claim 4, wherein the first rotatable shaft has opposite end portions, one opposite end portion being connected to the socket and the other opposite end portion being connected to the supplemental power source.

6. A top spinning toy according to claim 5, wherein the supplemental power source includes a second rotatable shaft, a second coil spring disposed around the second rotatable shaft, and a coupling disposed on an end of the second rotatable shaft, the coupling being fitted over one of the end portions of the first rotatable shaft, the first and second coil springs being wound by rotation of the first and second rotatable shafts which rotate in unison.

7. A top spinning toy according to claim wherein the top is insertable into the socket by rotating in one direction and removable from the socket by spinning in an opposite direction.

8. A top spinning toy according to claim 1, further comprising a platform having a concave surface on which the top spins after being rotated by the socket.

9. A top spinning toy comprising:

at least one top spinner including an elongated socket having an inner surface and a spiral groove formed in the inner surface; and at least one elongated top substantially received in the elongated socket and having an outer surface and a spiral projection formed on the outer surface, the spiral projection of the elongated top being receivable in the spiral groove of the socket, the spiral groove and projection providing means for transmitting rotational force of the socket to the top, wherein the at least one top spinner includes a spring wound mechanical motor having a rotatable shaft, attached to said socket, wherein the top has a conically shaped lower end, an elongated upper body, and a cylindrical portion between the upper body and the conically shaped end, and wherein the spiral projection is formed on the cylindrical portion of the top, the cylindrical portion having an outer diameter which is slightly smaller than an inner diameter of the socket.

10. A top spinning toy according to claim 9, wherein the spring wound mechanical motor includes a hollow body supporting a first rotatable shaft, a spring disposed around the first rotatable shaft and having one end connected to the first rotatable shaft and an opposite end connected to the hollow body, a ratchet wheel connected to the first rotatable shaft, a pawl which is spring biased into engagement with the ratchet wheel to allow rotation of the first rotatable shaft in a winding direction, thus winding the spring, and to prevent the first rotatable shaft from rotating in an opposite, unwinding direction, and a release mechanism for disengaging the pawl from the gear thus allowing the first rotatable shaft to rotate freely in the unwinding direction by virtue of the spring unwinding.

11. A top spinning toy according to claim 9, further comprising a supplemental power source connectable to the first rotatable shaft for enhancing a power output of the first rotatable shaft.

12. A top spinning toy according to claim 11, wherein the first rotatable shaft has opposite end portions, one opposite end portion being connected to the socket and the other opposite end portion being connected to the supplemental power source.

13. A top spinning toy according to claim 12, wherein the supplemental power source includes a second rotatable shaft, a second coil spring disposed around the second rotatable shaft, and a coupling disposed on an end of the second rotatable shaft, the coupling being fitted over one of the end portions of the first rotatable shaft, the first and second coil springs being wound by rotation of the first and second rotatable shafts which rotate in unison.

14. A top spinning toy according to claim 9, wherein the spring wound mechanical motor includes a spring disposed around the first rotatable shaft, a pawl which allows rotation of the first rotatable shaft in a winding direction and prevents rotation of the first rotatable shaft in an opposite, unwinding direction, the spring being wound by rotation of the rotatable shaft in the winding direction and unwound by rotation of the rotatable shaft in the opposite, unwinding direction, and a release mechanism for releasing the pawl.

15. A top spinning toy according to claim 14, wherein the detent means comprises a gear connected to the first rotatable shaft, and a detent which is spring biased into engagement with the gear, the release mechanism being connected to the detent to move the detent into and out of engagement with the gear.

16. a top spinning toy comprising:

at least one top spinner including an elongated socket having an inner surface and a spiral groove formed in the inner surface; and at least one elongated top substantially received in the elongated socket and having an outer surface and a spiral projection formed on the outer surface, the spiral projection of the elongated top being receivable in the spiral groove of the socket, the spiral groove and projection providing means for transmitting rotational force of the socket to the top, wherein the at least one top spinner includes a spring wound mechanical motor having a rotatable shaft attached to said socket, wherein the spring wound mechanical motor includes a spring disposed around the first rotatable shaft, a pawl which allows rotation of the first rotatable shaft in a winding direction and prevents rotation of the first rotatable shaft in an opposite, unwinding direction, the spring being wound by rotation of the rotatable shaft in the winding direction and unwound by rotation of the rotatable shaft in the opposite winding direction, and a release mechanism for releasing the pawl and wherein the spring wound mechanism motor further includes a gear connected to the first rotatable shaft, and a detent which is spring biased into engagement with the gear, the release mechanism being connected to the detent to move the detent into and out of engagement with the gear.

17. A top spinning toy comprising:

at least one top spinner including an elongated socket having an inner surface and a spiral groove formed in the inner surface; and at least one elongated top substantially received in the elongated socket and having an outer surface and a spiral projection formed on he outer surface, the spiral projection of the elongated top being receivable in the spiral groove of the socket, the spiral groove and projection providing means for transmitting rotational force of the socket to the top, wherein the at least one top spinner includes a spring wound mechanical motor having a rotatable shaft attached to said socket, and wherein the spring wound mechanical motor includes a hollow body supporting a first rotatable shaft, a spring disposed around the first rotatable shaft and having one end connected to the first rotatable shaft and an opposite end connected to the hollow body, a ratchet wheel connected to the first rotatable shaft, a pawl which is spring biased into engagement with the ratchet wheel to allow rotation of the first rotatable shaft in a winding direction, thus winding the spring, and to prevent the first rotatable shaft from rotating in an opposite, unwinding direction, and a release mechanism for disengaging the pawl from the gear thus allowing the first rotatable shaft to rotate freely in the unwinding direction by virtue of the spring unwinding.

* * * * *

UNITED STATES PATENT AND TRADEMARK OFFICE

CERTIFICATE OF CORRECTION

PATENT NO. : 4,932,918

DATED : June 12, 1990

INVENTOR(S) : Takayuki Onoda

It is certified that error appears in the above-identified patent and that said Letters Patent is hereby corrected as shown below:

Col. 5, line 1, "claim wherein" should be --claim 1, wherein--.

Col. 6, line 32, "pawl and" should be --pawl, and--;
line 33, "mechanism" should be --mechanical--.

Signed and Sealed this

Fourteenth Day of May, 1991

*Attest:*

HARRY F. MANBECK, JR.

*Attesting Officer*

*Commissioner of Patents and Trademarks*